US009874406B2

(12) United States Patent
Fuchs et al.

(10) Patent No.: US 9,874,406 B2
(45) Date of Patent: Jan. 23, 2018

(54) PASSIVE TWO-PHASE COOLING CIRCUIT

(71) Applicant: AREVA GMBH, Erlangen (DE)

(72) Inventors: Thomas Fuchs, Wesseling (DE); Leo Ornot, Nuremberg (DE); Markus Reck, Erlangen (DE); Matthias Reuter, Groitzsch (DE)

(73) Assignee: Areva GmbH, Erlangen (DE)

( * ) Notice: Subject to any disclaimer, the term of this patent is extended or adjusted under 35 U.S.C. 154(b) by 0 days.

(21) Appl. No.: 15/263,857

(22) Filed: Sep. 13, 2016

(65) Prior Publication Data

US 2016/0377352 A1 Dec. 29, 2016

Related U.S. Application Data

(63) Continuation of application No. PCT/EP2015/055529, filed on Mar. 17, 2015.

(30) Foreign Application Priority Data

Mar. 19, 2014 (DE) ..... 10 2014 205 086

(51) Int. Cl.

| | |
|---|---|
| ***F28D 15/02*** | (2006.01) |
| ***F25B 23/00*** | (2006.01) |
| ***F28F 19/00*** | (2006.01) |

(52) U.S. Cl.

CPC ..... *F28D 15/0266* (2013.01); *F25B 23/006* (2013.01); *F28D 15/025* (2013.01); *F28F 19/00* (2013.01); *F28D 2015/0216* (2013.01); *F28F 2230/00* (2013.01); *F28F 2265/12* (2013.01); *F28F 2265/30* (2013.01)

(58) Field of Classification Search

CPC .... F28F 19/00; F28F 2230/00; F28F 2265/12; F28F 2265/30; F28D 15/025; F28D 15/0266; F28D 15/0262; F25B 23/006

See application file for complete search history.

(56) References Cited

U.S. PATENT DOCUMENTS

| | | | | |
|---|---|---|---|---|
| 3,977,364 A * | 8/1976 | Gijsbers | ..... | B01D 1/065 122/366 |
| 4,314,601 A | 2/1982 | Giuffre et al. | | |
| 5,337,574 A * | 8/1994 | Dick | ..... | F24F 1/022 165/244 |

(Continued)

FOREIGN PATENT DOCUMENTS

DE 102008025544 A1 12/2009

*Primary Examiner* — Tho V Duong

(74) *Attorney, Agent, or Firm* — Laurence A. Greenberg; Werner H. Stemer; Ralph E. Locher

(57) ABSTRACT

A passive two-phase cooling circuit includes a vaporizer and a condenser for a coolant conducted in the cooling circuit. A vaporizer supply line and a vaporizer discharge line are connected to the vaporizer, and a condenser supply line and a condenser discharge line are connected to the condenser. The cooling circuit has a simple and cost-effective structure which reduces or even completely prevents pressure shocks during operation by connecting the vaporizer supply line, the vaporizer discharge line, the condenser supply line and the condenser discharge line to a common damping container. A liquid column forms in the condenser discharge line during the operation of the cooling circuit and the column assumes the function of a liquid-tight seal and of a fluid-dynamic vibration damper.

5 Claims, 3 Drawing Sheets

(56) References Cited

U.S. PATENT DOCUMENTS

| | | | | |
|---|---|---|---|---|
| 6,477,847 | B1 | 11/2002 | Bonaquist et al. | |
| 2005/0115698 | A1* | 6/2005 | Hsu | F28D 15/0266 165/104.33 |
| 2007/0289721 | A1* | 12/2007 | Miyagawa | F28D 15/0266 165/104.21 |
| 2013/0091880 | A1* | 4/2013 | Inadomi | F25B 1/00 62/119 |

* cited by examiner

PASSIVE TWO-PHASE COOLING CIRCUIT

CROSS-REFERENCE TO RELATED APPLICATION

This is a continuation application, under 35 U.S.C. §120, of copending International Application PCT/EP2015/055529, filed Mar. 17, 2015, which designated the United States; this application also claims the priority, under 35 U.S.C. §119, of German Patent Application DE 10 2014 205 086.3, filed Mar. 19, 2014; the prior applications are herewith incorporated by reference in their entirety.

BACKGROUND OF THE INVENTION

Field of the Invention

The invention relates to a passive two-phase cooling circuit including a vaporizer and a condenser for a coolant conducted in the cooling circuit, a vaporizer supply line and a vaporizer discharge line connected to the vaporizer, a condenser supply line and a condenser discharge line connected to the condenser, the vaporizer supply line, the vaporizer discharge line, the condenser supply line, and the condenser discharge line being connected to a common damping container. A liquid column of liquid coolant forms in the condenser discharge line during operation of the cooling circuit and the liquid column assumes a function of a liquid-tight seal and a function of a fluid-dynamic vibration damper.

Two-phase heat transportation systems, in which the coolant (also referred to as refrigerant) conducted in a circuit undergoes a phase transition from the liquid to gaseous phase and back again, allow high rates of heat transportation when driving temperature differences are low, by comparison with single-phase circuits. However, two-phase systems have much more freedom and therefore are more difficult to control than single-phase systems. That applies, in particular, to passive systems which manage without active measures for influencing flow, such as electric pumps or the like, and in which the transportation of the coolant is in fact brought about only by the differences in temperature prevailing between the associated heat source and heat sink. In particular, irregular pressure fluctuations and pressure shocks, especially condensation-induced pressure surges, in the pipe system present a significant problem, since extreme mechanical stresses can occur in that context. In the worst case scenario, they can lead to the destruction of the system.

SUMMARY OF THE INVENTION

It is accordingly an object of the invention to provide a passive two-phase cooling circuit, which overcomes the hereinafore-mentioned disadvantages of the heretofore-known systems of this general type, which has a simple and cost-effective structure and in which pressure shocks during operation are reduced or even completely prevented.

With the foregoing and other objects in view there is provided, in accordance with the invention, a passive two-phase cooling circuit, comprising a vaporizer and a condenser for a coolant conducted in the cooling circuit, a vaporizer supply line and a vaporizer discharge line connected to the vaporizer, a condenser supply line and a condenser discharge line connected to the condenser, and a damping container having a cover region and an internal space. The vaporizer supply line, the vaporizer discharge line, the condenser supply line, and the condenser discharge line are connected to the damping container. A liquid column of liquid coolant forms in the condenser discharge line during operation of the cooling circuit, the liquid column assumes a function of a liquid-tight seal and a function of a fluid-dynamic vibration damper, the condenser discharge line feeds into the cover region of the damping container, the condenser discharge line includes a pipe portion projecting into the internal space of the damping container, and the liquid-tight seal is produced in the pipe portion.

An important component of the apparatus is a damping container, which is also referred to as a decoupling container, having a volume which is to be adapted for specific structures and including at least four connections for the pipes of the cooling circuit leading to the vaporizer and to the condenser as well as the pipes leading away therefrom. In addition, a tubular component is attached to the connection for the condenser return line which allows the formation of a liquid column. The liquid column calms the flow in transient regions in which it acts as a hydrodynamic vibration damper. In addition, by using the liquid column, pressure is reduced at the output of the condenser, resulting in an increase in the driving pressure difference in the condenser and thus in an increased mass flow rate.

In summary, the pressure shocks feared up to now in passive two-phase systems can be reduced or even completely prevented by using the proposed apparatus, which functions as a fluid-dynamic vibration damper. Furthermore, by using the altered pressure ratios in the circuit, a directed flow can be induced or stabilized (minimizing or eliminating secondary return flows), the driving pressure difference in the condenser can be increased, the mass flow rate establishing the heat transportation can be increased, and thus, as a result, a significant performance increase can be achieved.

In other words, the proposed modification of a two-phase cooling circuit by using passive stabilization and increased performance brings about much more robust operation and thus increased practicability by comparison with previous systems. Through the use of the increased power density of the two-phase system, large amounts of heat can be passively discharged when driving temperature differences are low, which cannot be achieved in single-phase systems.

For example, in the nuclear sector, potential applications include discharging heat from wet storage facilities, cooling components (for example in pumps, Diesel generator sets, transformers), cooling containments and cooling spaces having an electrically-induced thermal load. Various applications in the non-nuclear sector are, of course, also possible.

Advantageously, the liquid-tight seal is disposed in the internal space of the damping container, in particular as an integral component thereof or as a component which is pre-mounted therein, and this makes the mounting of the whole system easier.

In a first advantageous variant, the liquid-tight seal, which is also referred to as a siphon, includes a U, S or J-shaped pipe portion, as is common for example in the field of household installations.

In a second advantageous variant, the liquid-tight seal is achieved in that a pipe or pipe end is immersed in a container or a vessel which laterally surrounds the pipe or pipe end and is open towards the internal space of the damping container so that it is possible to form a liquid column.

In a preferred embodiment, the vaporizer supply line and the vaporizer discharge line open into the base region of the damping container, more specifically preferably at a distance from one another. In this way, it is ensured that firstly, the mixture of liquid and vaporized coolant flowing in through the vaporizer discharge line can separate in the damping container, and that secondly, the liquid coolant collecting in the base region can flow off into the vaporizer supply line in a simple and unimpeded manner.

By contrast, the condenser supply line preferably opens into the cover region of the damping container so that the vapor collecting above the liquid coolant can flow into the line in a simple and unimpeded manner.

In order to support the natural circulation in the cooling circuit, the damping container is preferably disposed below the condenser, and the condenser discharge line, possibly apart from the portion containing the liquid-tight seal, is formed at least predominantly as a downpipe.

The advantages achieved by using the invention reside in particular in the fact that, by decoupling the circuits from the vaporizer and the condenser and by producing a fluid-dynamic vibration damper, regulating measures are achieved in a passive system in order to establish a stable and directed flow in the vaporizer and condenser.

Other features which are considered as characteristic for the invention are set forth in the appended claims.

Although the invention is illustrated and described herein as embodied in a passive two-phase cooling circuit, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
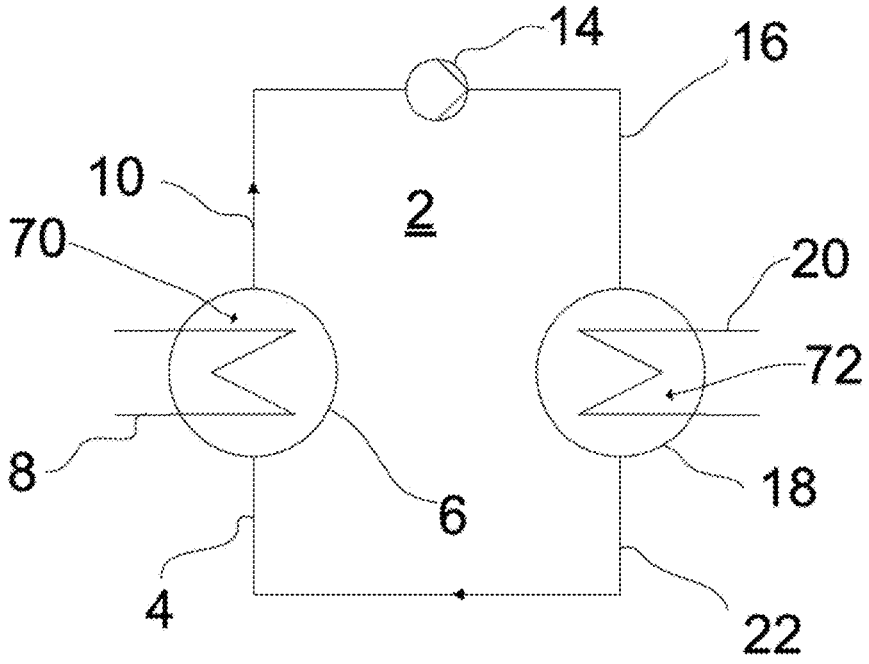
FIG. 1 PRIOR ART
FIG. 1 is a schematic diagram showing a passive two-phase cooling circuit according to the prior art.

Referring now in detail to the figures of the drawings which show an embodiment of the invention in a very simplified and schematic form in which like parts or parts having like effects are provided with the same reference numerals and first, particularly, to FIG. 1 thereof, there is seen a schematic overview of a conventional cooling circuit 2, as is used in various technical applications which relate to transporting away excess heat from heated regions of facilities. The directions of flow of the fluids in question are illustrated in each case by flow arrows.

A coolant conducted in a circuit firstly enters a vaporizer 6 in liquid form through a vaporizer supply line 4 (also referred to as a vaporizer intake or feed line). The vaporizer 6 is in the form of a heat exchanger which is heated by using a thermally coupled heat source 70, which is shown herein purely by way of example in the form of a heating pipe 8 conducting a heating medium. The coolant is vaporized at least in part in the vaporizer 6 by a transfer of heat from the heat source 70. The coolant vapor produced in this way leaves the vaporizer 6 through a vaporizer discharge line 10 (also referred to as a vaporizer return line or vapor line).

Further downstream, the coolant vapor enters a condenser 18 through a condenser supply line 16 (also referred to as a condenser intake). The condenser 18 is in the form of a heat exchanger which is thermally coupled to a heat sink 72, which is shown herein purely by way of example in the form of a cooling pipe 20 conducting a cooling medium. The coolant vapor is condensed in the condenser 18 by transferring heat to the heat sink 72. The coolant which is liquefied once again in this way leaves the condenser 18 through a condenser discharge line 22 (also referred to as a condenser return line), which transitions into the vaporizer supply line 4 further downstream so that the circuit starts again there.

In the case of a cooling circuit having forced flow, a pump 14 for transporting the coolant is connected between the vaporizer discharge line 10 and the condenser supply line 16.

For various applications, however, the cooling circuit 2 is preferably in the form of a passive circuit which manages without active components, in particular without pumps. In that case, the vaporizer discharge line 10 transitions directly into the condenser supply line 16. In that case, the circulation of the coolant is brought about according to the principle of natural circulation by using the difference in temperature between the heat source 70 and the heat sink 72. For that purpose, the components in question are disposed at a suitable geodetic height relative to one another and are suitable for measuring the respective pipe cross sections, etc. The boiling temperature of the coolant is determined in a suitable manner according to the combination of temperature and pressure ratios in the cooling circuit 2 so that the desired vaporization in the vaporizer 6 and the condensation in the condenser 18 actually take place. Due to the phase changes in the coolant from the liquid to gaseous phase and back again, the circuit is referred to as a two-phase cooling circuit.

Two-phase heat transportation systems allow high rates of heat transportation when driving temperature differences are low. However, pressure shocks or condensation shocks present a significant problem, since extreme mechanical stresses can occur. In the worst case scenario, they can lead to the destruction of the system.

Due to the transient and sometimes chaotic processes in the flow-conducting components, strong fluctuations or vibrations can in particular occur in the system, and therefore vapor-conducting flow regions are shifted into regions with cooler wall temperatures. Then, in some circumstances, the vapor condenses suddenly, thus leading to the above-mentioned condensation shocks.

That can be understood roughly as follows: When a vapor bubble forms in a pipeline of the vaporizer, a strong cooling of the environment takes place. A cyclic cooling of the pipe wall is of particular interest. That means that the wall needs some time to warm up again and reach the required overheating. Strong fluctuations are thus present locally, which vibrate at a specific frequency. Since different boiling ranges are present in the vaporizer pipe, which vibrate at difference frequencies, even in the case of an overall stationary state, a transient state still arises locally. However, since the local boiling conditions in passive systems are still responsible for the propulsion of the flow, there are always flow fluctuations. In the worst case scenario, resonance occurs locally or globally, and the entire system falls into a very disadvantageous state (possibly with considerably reduced heat discharge).

In addition, there is also the following disadvantage: Depending on the level on which the heat sink is located, the condensate may be super-cooled in the condenser. The super-cooled liquid must first be reheated to boiling temperature in the vaporizer. However, since single-phase heat transfer is considerably worse than two-phase heat transfer, the potential of the vaporizer is only utilized to an insufficient extent.

Figure 2:
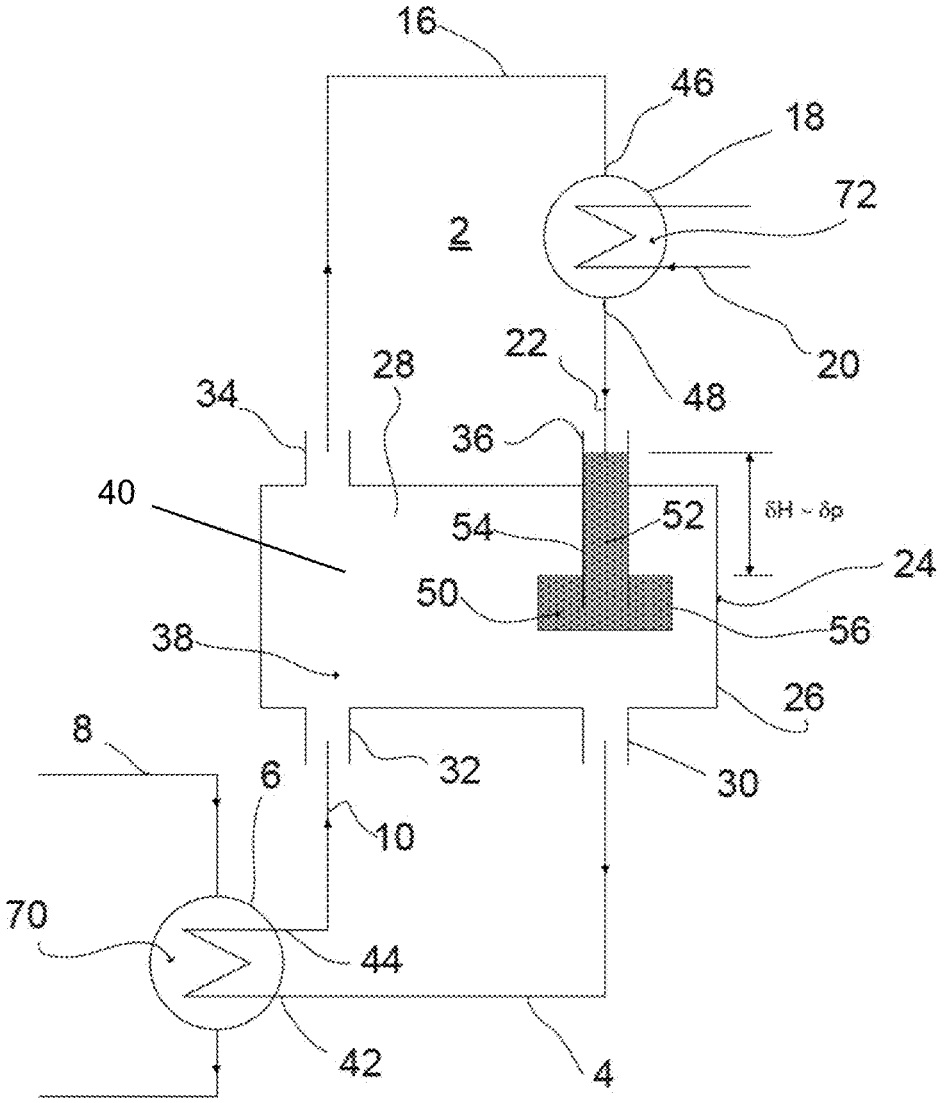
FIG. 2 is a schematic diagram showing a passive two-phase cooling circuit according to the invention.

Such phenomena are reduced or even completely prevented according to the invention by using the apparatus proposed in FIG. 2. The following description builds on the description of FIG. 1 and concentrates on the modifications which have now been made to the cooling circuit 2.

An important element of the modification is a damping container 24, which is integrated in the cooling circuit 2 and acts as a fluid-dynamic vibration damper in conjunction with a liquid column. The damping container can also be referred to as a decoupling container referring to the function thereof of decoupling the vaporizer and condenser circuits (see below). The damping container 24 includes an internal space 28 which is sealed on all sides in a pressure-tight manner with respect to the environment by a surrounding wall 26. The volume of the internal space is sufficiently large to carry out the main tasks assigned thereto of damping vibrations and conducting media. Furthermore, four connections 30, 32, 34, 36 which have functions that are different from one another are connected to the pipe system of the cooling circuit 2 in a specific manner. During the operation of the cooling circuit 2, liquid coolant and coolant vapor collect in the internal space 28 of the damping container 24. The liquid phase collects at the bottom towards a base region 38 as a result of gravity acting thereon, and the gaseous/vaporous phase collects above the liquid phase towards a cover region 40.

A first connection 30 is guided through the surrounding wall 26 in the base region 38 of the damping container 24, in particular directly in the base. The connection 30 is connected to the vaporizer supply line 4 leading to a vaporizer inlet 42, so that liquid coolant collecting in the base region 38 during operation flows through the connection 30 and the vaporizer supply line 4 to the vaporizer 6, where the vaporization of the coolant takes place.

The vaporizer discharge line 10 coming from a vaporizer outlet 44 is connected to a second connection 32, which is likewise guided through the surrounding wall 26 in the base region 38 of the damping container 24, in particular directly in the base, or optionally slightly higher. In general, the coolant in the vaporizer 6 is not vaporized completely, but rather is vaporized only in part, and the resulting mixture of liquid coolant and coolant vapor is thus conducted through the vaporizer discharge line 10 and the connection 32 into the internal space 28 of the damping container 24, where a phase separation takes place as described previously.

A third connection 34 is guided through the surrounding wall 26 in the cover region 40 of the damping container 24, in particular directly in the cover. The condenser supply line 16 leading to a condenser inlet 46 is connected to the third connection 34, so that coolant vapor collecting in the cover region 40 flows through the connection 34 and the vaporizer supply line 16 to the condenser 18, where the condensation of the coolant vapor takes place.

Lastly, a fourth connection 36 is guided through the surrounding wall 26 in the cover region 40 of the damping container 24, in particular directly in the cover. The condenser discharge line 22 coming from a condenser outlet 48 is connected to the fourth connection 36, so that the coolant which is liquefied in the condenser 18 flows into the damping container 24 through the condenser discharge line 22 and the connection 36.

In the case of the three connections 30, 32, 34 mentioned first, the connected pipelines 4, 10, 16 open directly into the internal space of the damping container 24 to the extent that, in the case of normal operational flow ratios, it is possible to compensate the pressure between the internal space 28 and those pipelines 4, 10, 16. By contrast, the fourth connection 36 is created in such a way that the pipeline which is connected thereto, namely the condenser discharge line 22, feeds into the internal space 28 of the damping container 24, thus forming a liquid-tight seal 50. A liquid-tight seal 50 of this type is also referred to as a siphon or trap. The passage of gases is prevented or in any case made more difficult by a liquid column 52 of liquid coolant forming during the operation of the cooling circuit 2, and therefore a pressure separation is achieved between the internal space 28 and the condenser discharge line 22. A height $\delta H$ of the resulting liquid column 52 correlates in this case to a prevailing pressure difference $\delta p$.

Figure 3:
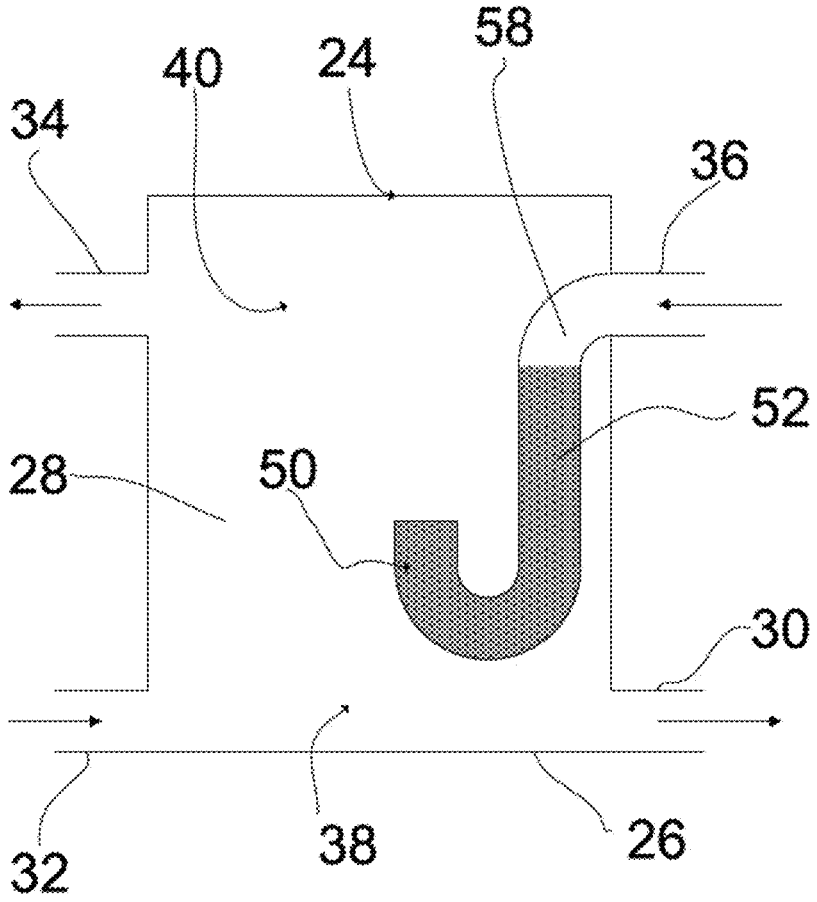
FIG. 3 is a schematic diagram showing an alternative variant of a portion of FIG. 2.

The liquid-tight seal 50 can in principle be disposed outside the damping container 24. Expediently, however, the seal is produced in a pipe portion in the internal space 28 of the damping container 24, and can take any form which is expedient for the function. For example, as shown in FIG. 2, the seal can include a pipe end 54, which is immersed from above in a container 56 which is open at the top. Alternatively or additionally, known U, S or J-shaped pipe portions 58 or embodiments having equivalent functions can be used, as shown in FIG. 3 by way of example, with reference to a J-bend.

The return flow of the vapor and the damping of the system are carried out through the use of the liquid column 52 of the siphon. This means that the liquid column 52 must be produced according to the expected system instabilities. In FIG. 2, the upwardly pointing opening of the surrounding container 56 has a considerably greater cross-sectional area than the immersed pipe 54. This means that a small difference in height in the container 56 leads to a considerably greater difference in height in the pipe 54 (corresponding to the area ratios). Since the overall height difference $\delta H$ correlates with the pressure difference $\delta p$, the pressure fluctuations in the system are counteracted. The installation height of the siphon must be determined according to the overall spread of the system. This means that, in the case of low thermal outputs, the liquid phase is predominantly located in the vaporizer region, with the container being virtually empty. In the case of high thermal outputs, a relatively large amount of the liquid phase is located in the container (due to the high proportion of vapor in the vaporizer). The components are to be laid out on this basis.

In order to support the natural circulation in the cooling circuit 2, the vaporizer 6, the condenser 18 and the damping container 24 are located at a suitable geodetic height relative to one another. In particular, the damping container 24 is preferably disposed below the condenser 18, so that the condenser discharge line 22 leading from the condenser 18 to the damping container 24 is substantially in the form of a downpipe. From a purely hydrostatic perspective, it is further considered to be advantageous to dispose the vaporizer 6 below the damping container 24. As a result, the vaporizer discharge line 10 is preferably a standpipe, and the vaporizer supply line 4 is preferably a downpipe. However, since this system is a fluid-dynamic system which is additionally a two-phase system, it is possible that, in practice, a different configuration would prove beneficial.

In summary, in the case of the cooling circuit 2 according to FIG. 2, both the pipe loop leading from the vaporizer 6 to the condenser 18 and the pipe loop leading from the condenser 18 to the vaporizer 6 are thus guided through the common damping container 24. The liquid column 52 in the damping container 24 together with the compensation volume created by the internal space 28 decouples the circuits and calms the flow in transient regions in which it acts as a hydrodynamic vibration damper. In addition, by using the liquid column 52, pressure is reduced on the outlet side in the condenser 18, resulting in an increase in the driving pressure difference in the condenser 18 and thus in an increased mass flow rate in the cooling circuit 2.

Another advantage of the damping container 24 is that the condensate is preheated. Since a (relative) vapor content of less than one is present at the vaporizer outlet 44, some of the saturated liquid flows through the damping container 24 back to the vaporizer inlet 42. In this case, the optionally super-cooled condensate is mixed with the saturated liquid. As a result, the regions of the single-phase heat transfer in the vaporizer 6 are minimized, and the overall process is improved (thermodynamic optimization).

The apparatuses shown in FIGS. 2 and 3 act both to improve the efficiency of the heat discharge and also to reduce condensation shocks in the case of a passive two-phase cycle.

The invention claimed:

1. A passive two-phase cooling circuit, comprising:

a vaporizer and a condenser for a coolant conducted in the cooling circuit;

a vaporizer supply line and a vaporizer discharge line connected to said vaporizer;

a condenser supply line and a condenser discharge line connected to said condenser;

a damping container having a cover region and an internal space;

said vaporizer supply line, said vaporizer discharge line, said condenser supply line, and said condenser discharge line being connected to said damping container;

a liquid column of liquid coolant forming in said condenser discharge line during operation of the cooling circuit, said liquid column assuming a function of a liquid-tight seal and a function of a fluid-dynamic vibration damper;

said condenser discharge line feeding into said cover region of said damping container, said condenser discharge line including a pipe portion projecting into said internal space of said damping container, and said liquid-tight seal being produced in said pipe portion.

2. The cooling circuit according to claim 1, wherein said pipe portion having said liquid-tight seal is U-shaped, S-shaped or J-shaped.

3. The cooling circuit according to claim 1, which further comprises a container having an open top, said liquid-tight seal including a pipe end immersed in said container.

4. The cooling circuit according to claim 1, wherein said damping container includes a base region, and said vaporizer supply line and said vaporizer discharge line open into said base region.

5. The cooling circuit according to claim 1, wherein said damping container is disposed below said condenser, and said condenser discharge line is a downpipe.

* * * * *